US005727983A

United States Patent [19]

Koldste

[11] Patent Number: 5,727,983

[45] Date of Patent: Mar. 17, 1998

[54] TOY BUILDING ELEMENT FOR USE AS A DUMP BODY AND A TOY TRUCK HAVING A DUMP BODY

[75] Inventor: Finn Koldste, Skovlunde, Denmark

[73] Assignee: INTERLEGO AG, Baar, Switzerland

[21] Appl. No.: 714,858

[22] Filed: Sep. 17, 1996

[51] Int. Cl.[6] ..... A63H 17/06

[52] U.S. Cl. ..... 446/428

[58] Field of Search ..... 446/428

[56] References Cited

U.S. PATENT DOCUMENTS

| | | | |
|---|---|---|---|
| 1,472,484 | 10/1923 | Mayer et al. | 446/428 X |
| 1,532,666 | 4/1925 | Wajer et al. | 446/428 |
| 2,736,990 | 3/1956 | Howard | 446/428 X |
| 3,462,879 | 8/1969 | Fahrendorff | 446/428 |
| 3,514,895 | 6/1970 | Ryan et al. | 446/428 |
| 3,605,331 | 9/1971 | Linstead | 446/428 |
| 5,383,808 | 1/1995 | Dubois | 446/428 |

*Primary Examiner*—William H. Grieb

*Attorney, Agent, or Firm*—Kane,Dalsimer,Sullivan, Kurucz, Levy, Eisele and Richard, LLP

[57] ABSTRACT

The invention concerns a toy building element which may be used as a dump body (1) for a toy vehicle. The toy building element comprises an open container part (3) and a bottom (4), the container part (3) and bottom (4) being hingedly interconnected, the bottom (4) being moreover provided to couple with other toy building elements. The toy building element has a substantially square base face, and at least two non-parallel sides, there being no parts which protrude beyond the substantially square base face. The invention also concerns a toy vehicle having such a dump body.

9 Claims, 1 Drawing Sheet

TOY BUILDING ELEMENT FOR USE AS A DUMP BODY AND A TOY TRUCK HAVING A DUMP BODY

Figure 1:
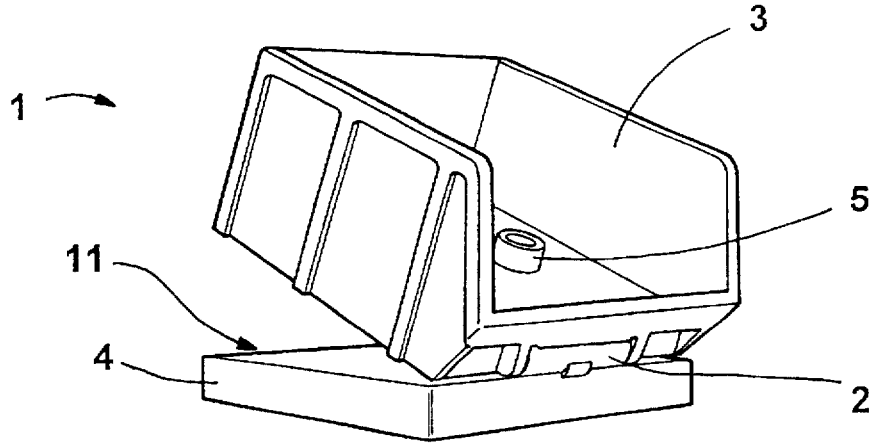

The invention concerns a toy building element for use as a dump body for a toy vehicle, said toy building element comprising an open container part and a bottom, said container part and bottom being hingedly interconnected, said bottom being moreover provided with coupling means for coupling with other toy building elements.

Such a toy building element is known in the form of a dump body which is hingedly connected with a dump body bottom, said dump body with dump body bottom forming part of a toy building system and being adapted to be coupled on a toy railway carriage. When mounted on the railway carriage, the dump body can be tilted laterally and thus allow emptying of the railway carriage outside the track.

This known dump body is hinged to the dump body bottom at the ends of the dump body, and the element as a whole has a length which is considerably greater than the width.

Toy trucks having a dump body permanently connected with the chassis of the truck are also known. Examples of such toy trucks are known e.g. from U.S. Pat. No. 3,605,331 and U.S. Pat. No. 5,383,808.

The dump body on these toy trucks is adapted to tilt rearwardly with respect to the travelling direction of the truck, as is also most common with real trucks. However, there are also real trucks where the body is tilted laterally to allow lateral unloading of the body, but this technique is not well-known in the field of toys.

Known are also toy building systems comprising a multitude of toy building elements with which it is possible to build e.g. a toy truck having a dump body. In case of such a toy truck, the truck itself and most frequently also the body are constructed from a large number of toy building elements, and the assembly between the dump body and the toy truck takes place by means of separate hinge elements. It is hereby possible to construct toy trucks with a dump body which may tilt rearwardly as well as laterally.

Of the above-mentioned known devices for a dump body for a toy truck it is just the last-mentioned dump body constructed from a plurality of toy building elements and connected with the truck by hinge elements which can be converted from titling rearwardly to tilting laterally. However, this requires that the dump body is constructed to tilt both rearwardly and laterally, and conversion also requires major manipulation of the constructed dump body truck. This involves a great risk that parts of the truck are disassembled inexpediently with subsequent assembly work.

For minor children it is moreover desirable to use few and large toy building elements for the building of e.g. a truck with a dump body, thereby minimizing the risk of undesired disassembly.

Accordingly, the object of the present invention is to provide a toy building element which may be used as a dump body to be mounted on a toy vehicle, and this dump body must be capable of being converted in a simple and safe manner from tilting rearwardly to tilting laterally, without the appearance of the toy vehicle being significantly changed by this.

This is achieved by arranging the toy building element mentioned in the opening paragraph such that the toy building element as a whole has a substantially square base face, and that it has at least two non-parallel sides, there being no parts which protrude beyond the substantially square base face.

This results in a toy building element which may be mounted as a dump body on a toy vehicle in at least two different positions without significantly changing the appearance, and without there being any protruding parts that might prevent 90° turning of the toy building element as a whole.

Preferably, the base has a square base face, and the container part is flat-bottomed with a square base face and is moreover arranged such that in its closed position it rests on the bottom along at least two sides. This ensures that the body can stand stably, also when it is not mounted on a toy vehicle, but merely stands on plane support. This presents additional possibilities of playing with the toy building element of the invention.

The hinge connection between the container part and the bottom is preferably positioned at one side of the lower edge of the container part and the upper edge of the bottom, respectively, so that the container part tilts around its lower rear edge when it is mounted to tilt rearwardly, or around a side edge when the toy building element is mounted to tilt laterally.

The container part may be open upwardly and internally be provided with coupling means for coupling with other toy building elements to allow other toy building elements to be mounted and be secured temporarily so that they do not drop out of the container part during transport with the toy vehicle on which the toy building element is mounted.

The invention also concerns a toy vehicle with a dump body, said toy vehicle comprising a chassis provided with wheels, said dump body comprising an open container part and a bottom, said container part and bottom being hingedly interconnected, said bottom being provided with coupling means for coupling with complementary coupling means on the chassis of the toy vehicle.

Such a toy vehicle is known from the previously mentioned toy railway carriage, but by arranging the toy vehicle such that the chassis of the toy vehicle comprises a substantially square, plane face with coupling means, that the dump body as a whole has a corresponding, substantially square base face, and that the dump body has at least two non-parallel sides, there being no parts which protrude beyond the substantially square base face, it is ensured that the toy vehicle may be converted in a simple manner from tilting rearwardly to tilting laterally, without significantly changing the appearance, and without there being any protruding parts that might prevent 90° turning of the toy building element as a whole.

In the preferred embodiment the toy vehicle is a toy truck having a driver's cab and a square, plane face which is rearwardly directed with respect thereto and which is provided with upwardly directed coupling studs, which may be coupled with complementary coupling means on the underside of the bottom of the dump body.

Figure 2:
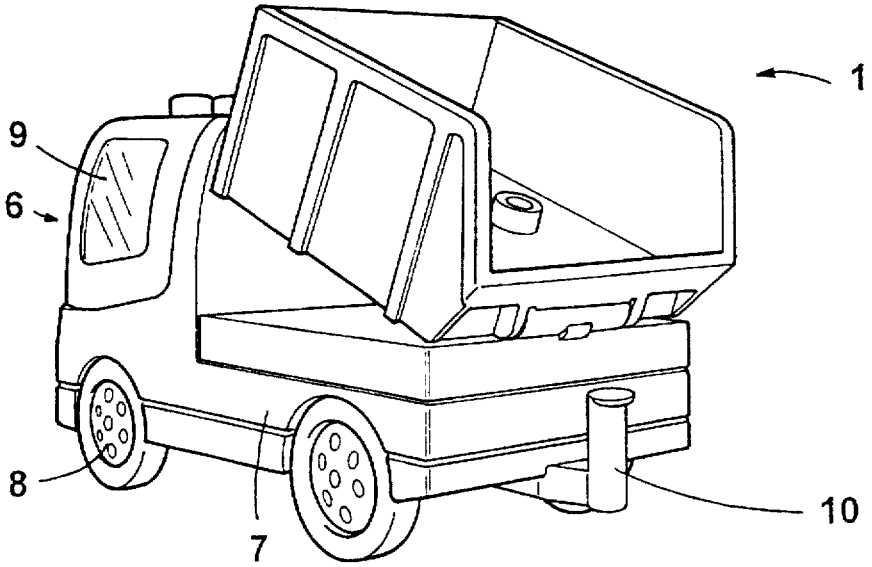
Figure 3:
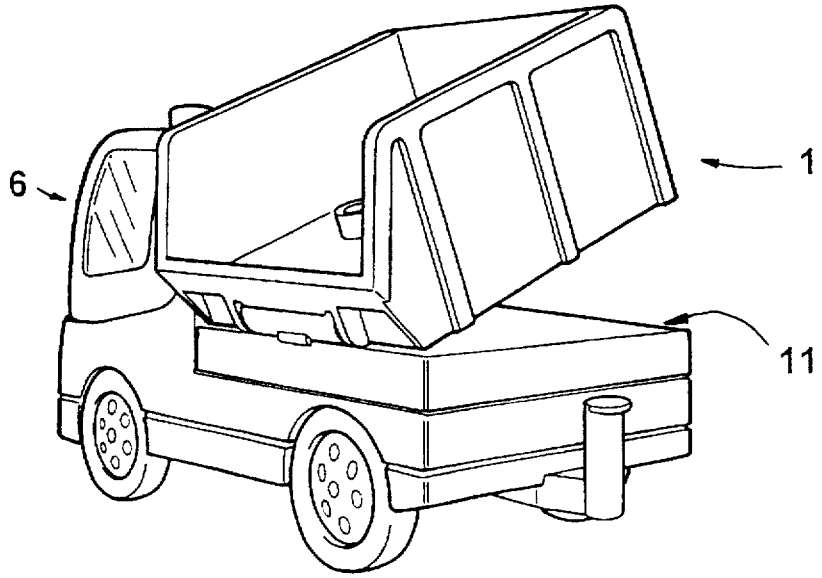

The invention will now be described more fully with reference to the drawing, in which FIG. 1 shows a preferred embodiment of the toy building element of the invention, FIG. 2 shows the toy building element mounted on a toy truck in a rearwardly tilting position, and FIG. 3 shows the same as FIG. 2, but with the toy building element in a laterally tilting position.

The toy building element, which is just called a dump body below, and which is generally designated by the reference numeral 1, consists of two parts which are interconnected via a hinge 2, viz. a container part 3 and a bottom 4.

The container part 3 is formed by an upwardly open, box-like unit having a substantially square bottom and four side walls, one of which is considerably lower than the others. In the embodiment shown, the bottom of the container part is provided with coupling studs 5 on which toy building elements may be coupled, so that these are secured during transport of the dump body 1.

The bottom 4, which is square in its base face, has a plane surface on which the container part 3 rests along its entire circumference when it is tilted down. The surface of the bottom 4 may be provided with means for detachably retaining the container part 3, so that it just takes a small force to tilt the container part 3. These retention means are not shown in the drawing.

The underside of the bottom 4 is provided with coupling means (not shown) so that the dump body 1 may be mounted on e.g. a toy truck, as shown in FIGS. 2 and 3.

The base face of the dump body 1 has a square shape, so that it may be mounted to tilt rearwardly (FIG. 2) or laterally (FIG. 3). The base 4 is substantially square and has two non parallel sides 11 beyond which no part of the dump body protrudes.

FIG. 2 shows the dump body 1 mounted to tilt rearwardly on a toy truck 6, which comprises a bottom 7, wheels 8 and a driver's cab 9. On the chassis at the rear end of the truck 6, the truck bottom 7 is equipped with a square, plane face provided with coupling means which mate with the coupling means positioned on the underside of the bottom 4 of the dump body 1. Preferably, the coupling means are formed by coupling studs protruding upwardly from the square, plane face and complementary recesses on the underside of the base 4. These coupling means are not shown in detail, as they are known from various toy building element systems.

In the embodiment shown, the toy truck 6 is provided with a hook 10 to allow a trailer to be towed by the truck.

According to the invention, the toy truck 6 with the dump body 1 can easily be changed from tilting rearwardly to tilting laterally, as shown in FIG. 3.

This is done by disassembling the entire dump body 1 (container part 3 and bottom 4), turning the dump body 1 90° and mounting it on the truck 6 again. The dump body 1 may optionally be mounted to tilt to the right or to the left.

FIGS. 1–3 show the preferred embodiment of the toy building element 1 and the toy vehicle of the invention. However, it is possible to vary the construction of these parts in many ways, without said parts departing from the idea of the invention.

For example, the hinge between the container part 3 and the bottom 4 may be constructed differently from what is shown. Thus, it is conceivable that the bottom 4 has upwardly extending arms at two opposed sides between which the container part 3 is hinged with a top hinge.

Further, the container part 3 may conceivably be constructed differently, e.g. as a more or less closed container or as a body having inclined walls, provided that its shape is still within the square base face of the tilting body as a whole.

I claim:

1. A toy building element for use as a dump body (1) for a toy vehicle, said toy building element comprising an open container part (3) and a bottom (4), said container part (3) and bottom (4) being hingedly interconnected, said bottom (4) being moreover provided with coupling means for coupling with other toy building elements, wherein the toy building element as a whole has a substantially square base face, and that it has at least two non-parallel sides, there being no parts which protrude beyond the substantially square base face.

2. A toy building element according to claim 1, wherein the bottom (4) has a square base face, that the container part (3) is substantially flat-bottomed and is arranged such that in its closed position it rests on the bottom (4) along at least two sides.

3. A toy building element according to claim 1, wherein the hinge connection (2) between the container part (3) and the bottom (4) is positioned at one side of the lower edge of the container part and the upper edge of the bottom, respectively.

4. A toy building element according to claim 1, wherein the container part (3) is open upwardly, and that it is internally provided with coupling means (5) for coupling with other toy building elements.

5. A toy vehicle having a dump body (1), said toy vehicle comprising a chassis provided with wheels (8), said dump body (1) comprising an open container part (3) and a bottom (4), said container part (3) and bottom (4) being hingedly interconnected, said bottom (4) being provided with coupling means for coupling with complementary coupling means on the chassis of the toy vehicle, wherein the chassis of the toy vehicle comprises a substantially square, plane face having coupling means, that the dump body (1) as a whole has a corresponding, substantially square base face, and that the dump body (1) has at least two non-parallel sides, there being no parts which protrude beyond the substantially square base face.

6. A toy vehicle according to claim 5, wherein the toy vehicle is a toy truck (6) having a driver's cab (9) and a square, plane face, directed rearwardly with respect thereto, to receive the dump body (1).

7. A toy vehicle according to claim 5, wherein the square, plane face of the toy vehicle is provided with upwardly directed coupling studs, and that the bottom (4) of the dump body is provided with complementary recesses on the underside for coupling with the coupling studs of the toy vehicle.

8. A toy building element according to claim 5, wherein the hinge connection (2) of the dump body between the container part (3) and the bottom (4) is positioned at one side of the lower edge of the container part and the upper edge of the bottom, respectively.

9. A toy vehicle according to claim 5, wherein the container part (3) is open upwardly, and that it is internally provided with coupling means (5) for coupling with other toy building elements.

* * * * *